US005200145A

United States Patent [19]

Krutenat et al.

[11] Patent Number: 5,200,145

[45] Date of Patent: Apr. 6, 1993

[54] ELECTRICAL STEELS AND METHOD FOR PRODUCING SAME

[75] Inventors: Richard C. Krutenat, Belmont, Mass.; Robert S. Barnard, Highland Heights, Ohio; John P. Dismukes, Annandale, N.J.; Bernard H. Kear, White House Station, N.J.; Horst Witzke, Flemington, N.J.

[73] Assignee: Exxon Research and Engineering Co., Florham Park, N.J.

[21] Appl. No.: 729,246

[22] Filed: Jul. 12, 1991

Related U.S. Application Data

[63] Continuation-in-part of Ser. No. 485,350, Feb. 26, 1990, abandoned, which is a continuation-in-part of Ser. No. 255,895, Nov. 11, 1988, Pat. No. 4,904,500, which is a continuation of Ser. No. 59,423, Jun. 8, 1987, abandoned.

[51] Int. Cl.[5] ..... C22C 33/00

[52] U.S. Cl. ..... 420/129; 420/77; 420/78; 420/103; 420/117; 148/113

[58] Field of Search ..... 420/77, 78, 103, 117, 420/129; 148/110, 111, 112, 113

[56] References Cited

U.S. PATENT DOCUMENTS 2,140,889 12/1938 Vogt ..... 420/78
3,756,867 9/1973 Brissonneau et al. ..... 148/111
4,177,092 12/1979 Thursby ..... 148/113
4,904,500 2/1990 Krutenat ..... 427/248.1

OTHER PUBLICATIONS

Metals Handbook, 9th ed., vol. 5, p. 340, American Society for Metals.

*Primary Examiner*—John P. Sheehan
*Attorney, Agent, or Firm*—Linda M. Scuorzo

[57] ABSTRACT

The present invention relates to a novel process for producing silicon and/or aluminum containing iron alloy product as well as the material produced from same in either sheet or bulk structure form for electromagnetic circuit application. The process entails modifying an iron feedstock containing less than about 2.5 wt % silicon, aluminum or a combination thereof. The process further consists of diffusion of silicon or silicon and aluminum or aluminum into an iron feedstock by a pack diffusion or a chemical vapor deposition method in which the iron feedstock is heated to a temperature at which diffusion occurs in the presence of a pack containing silicon and/or aluminum sources, a reducing agent, a catalyst, and a filler, or in the presence of a flowing gas stream containing a volatile silicon compound. The resulting iron alloy product, which has a silicon content in the range of 0.25%—7% silicon, and an aluminum content in the range of about 0%—4% aluminum, has favorable properties for motor and transformer applications.

25 Claims, 1 Drawing Sheet

ELECTRICAL STEELS AND METHOD FOR PRODUCING SAME

This is a continuation-in-part of U.S. Ser. No. 485,350 filed Feb. 26, 1990, which is a continuation-in-part of U.S. Ser. No. 255,895 filed Oct. 11, 1988, which is a Rule 60 continuation of U.S. Ser. No. 059,423 filed Jun. 8, 1987, abandoned.

BACKGROUND OF THE INVENTION

1. Field of the Invention

The invention relates to silicon and silicon and aluminum diffused iron alloys and a process for manufacturing electric products such as, motor laminations and transformer cores from these alloys.

2. Description of the Prior Art

In making various electrical products, e.g. motor laminations and transformer cores, it is desirable to use thin gauge sheets of iron or an iron alloy as the product that contain diffused silicon or silicon and aluminum (hereinafter referred to as "iron alloy product"). Increasing the silicon or silicon and aluminum content of the iron alloy product, significantly improves the electromagnetic performance making these materials more attractive for electromagnetic components of electrical products.

First, it reduces eddy current losses and thus core losses associated with the material. This is accomplished by the increase in electrical resistivity associated with increased silicon or silicon and aluminum alloy content. This combination of properties is difficult to achieve with conventional methods for producing iron. Second, the magnetostriction of the iron is decreased, thereby reducing the mechanical and subsequently electrical losses. Thirdly, the coercive forces in the iron are reduced but these can also be reduced further by lowering the interstitial element content of the iron alloy product; e.g. carbon and nitrogen to remove pinning sites for magnetic domains. Lastly, the magnetic properties in the plane of a thin gauge iron alloy product sheet can be substantially non-oriented, textured or oriented. For example, in the manufacture of electric motor laminations, it is generally desirable to produce an iron sheet having a grain structure that is randomly oriented in the plane of the iron sheet with the <111> orientation removed from the plane of the sheet; as such, less energy is required to magnetize and demagnetize the material. However, in the manufacture of transformer cores, it is desirable to have an oriented grain boundary structure within the plane of the alloy product sheet which is oriented in the flux carrying direction.

The literature is replete with processes describing how to make silicon steel. These processes usually involve an iron based raw material having a silicon content of less than 3 wt. %. When the silicon content is increased further, the iron becomes more difficult to cold roll into thin gauge sheets; see U.S. Pat. No. 3,423,253. European Patent 0198084 and U.S. Pat. No. 3,224,909 both discuss a method for improving the magnetic characteristics of iron used in the manufacture of electrical products. The method involves casting the iron into an ingot, typically having greater than 3 wt. %, slabbing the ingot, and hot rolling to form a continuous band. Thereafter, the band is subjected to a plurality of cold rolling steps. After cold rolling, the iron or iron alloy containing (hereinafter referred to as "iron alloy") band is heated in a gaseous atmosphere containing a volatile silicon compound selected from, for example, silicon halides, silane, substituted silane, silicon tetraacetate and silicon tetrathiocyanate. Cold rolling the iron would also produce an iron alloy having an undesirable equiaxial grain structure. In addition to this, the interstitial content of the iron alloy could not be reduced to the desired low levels without further processing, unless a high cost, special steel making practice was employed.

There has been little success in economically manufacturing iron containing 6.5 wt. % Si and greater where conventional processing techniques can be employed, e.g. cold rolling, since iron alloy having these elevated silicon levels embrittles easily and is not amenable to cold rolling. A developmental procedure that evolved required a rapid solidification of the iron and forming iron sheets directly from an iron melt. See U.S. Pat. No. 4,142,571. However, this process is expensive and therefore impractical for manufacturing large quantities of iron sheets for making electrical products.

The earliest description of using chemical vapor deposition for increasing the silicon content of silicon steel sheet is in U.S. Pat. Nos. 3,224,909 and 3,423,253. Further improvements of these chemical vapor deposition methods for fabricating steel of high silicon content were described by K. Nakaoka, et al., European Patent 85904865.4 and the properties of silicon-steel sheet of approximately 6.5 wt. % Si have been described by Takada, Abe, Masuda and Inagaki, J. Appl. Phys. 64 (10), pp. 5367–5369 (1988). Nakaoka describes siliconizing a steel sheet, containing 3 or more wt. % Si, in a flowing gas stream to increase the silicon content further to about 6.5 wt. %. The 3 wt. % Si sheet was heated in an atmosphere containing silicon tetrachloride in concentrations up to 50% for times up to 50 minutes, at a temperature between about 1100° C. and about 1200° C., at a controlled heating and cooling rate, to obtain high permeability silicon-steel sheet of about 6.5 wt. % Si, without internal flaws. After the siliconizing step, the silicon sheet was then annealed for homogenization at a temperature of about 1200° C. for about two hours.

U.S. Pat. No. 4,904,500 discloses a pack diffusion technique where iron or iron alloy is placed in a retort, or chamber, and diffused with silicon by catalyzed oxide reduction. However, unlike the diffusion process described in U.S. Pat. No. 3,224,909 mentioned above, the diffusant species in pack diffusion is not introduced directly as a gaseous species, but is derived as product of the concurrent chemical reaction of reagents inside the retort. To effectively diffuse silicon into iron and preclude the outward diffusion of iron therefrom, the activity of the gaseous stream species or the diffusant species must be maintained at a sufficiently low level to allow the deposited silicon to be adsorbed by the substrate as soon as it is deposited on the surface.

Although the techniques described above can produce silicon steel sheet with silicon contents in the range 3 wt. % Si, they involve numerous manufacturing steps, and in particular use an expensive silicon steel sheet of greater than about 3 wt. % Si as the starting material. No methods have been described which allow the use of low silicon content material, including low carbon steel as the starting material, which offers considerable cost savings on materials. In addition, synthesis of silicon steel sheet in near net shape for cost improvements is not described. The present invention offers such advantages.

An object of this invention is to provide an iron alloy product having silicon or silicon and aluminum diffused therein, produced from an iron feedstock containing less than about 2.5 wt. % silicon or aluminum or a combination of silicon and aluminum, wherein the alloy product (a) is in the form of thin gauge iron sheets; (b) has a low interstitial content (c) has a columnar grain boundary structure within the plane of a sheet of the iron alloy product, wherein the magnetic properties within a plane of the sheet of the iron alloy product is substantially non-oriented, textured or grain-oriented; (d) has improved magnetic characteristics; (e) has reduced core loss; and (f) has reduced magnetostriction.

Another object of the invention is to provide methods for making an iron alloy product having silicon or silicon and aluminum diffused therein for the manufacture of electric motor laminations and transformer cores with reduced core loss and reduced magnetostriction.

Another object of the invention is to provide a method for manufacturing electric products, such as motor laminations and transformer cores, that reduces the amount of wasted metal used in the manufacturing process.

Other objects of the invention will become apparent to those skilled in the art upon reading the following description, to be taken in conjunction with the specific examples provided herein for illustrative purposes.

SUMMARY OF THE INVENTION

In one aspect the invention is an iron alloy product comprising: about 0.25 wt. % to about 7.0 wt. % diffused silicon; zero to about 4 wt. % diffused aluminum; with the balance being iron; a maximum interstitial content of less than about 100 ppm, preferably less than about 30 ppm; and having a columnar grain boundary structure, wherein the orientation of the magnetic properties within a plane of the sheet of the iron alloy product is substantially non-oriented, textured or grain-oriented. Controlled activity diffusion siliconizing and aluminizing of iron feedstock by pack or flowing gas processing typically can be used to produce a columnar grain structure in the iron alloy product, which structure is substantially isotropic or slightly textured. Both to tailor the degree of texturing and to achieve grain orientation, the iron feedstock may be subjected to controlled pretreatment steps such as thermal treatments, mechanical deformation treatments and treatments for modification of surface chemistry and microstructure. The purpose of these pretreatment steps is to tailor nucleation to control the directionality of the resulting grain growth.

In another aspect, the invention is a pack method for making iron alloy products having silicon or silicon and aluminum co-diffused therein that comprises: adding to a retort (1) an iron alloy feedstock or substrate containing less than about 2.5 wt % silicon or silicon and aluminum (hereinafter referred to as "iron feedstock" or "iron substrate"); (2) a silicon oxide source; or a combination of silicon oxide and aluminum sources; (3) an activator; and (4) an inert filler and forming a mixture of ingredients and providing a non-oxidizing atmosphere within the retort; heating the mixture for a time sufficient to reduce the silicon oxide source and create a silicon diffusant or silicon and aluminum diffusant to diffuse silicon or silicon and aluminum into the iron feedstock and recovering an iron alloy product with a final silicon content of about 0.25 wt. % to about 7.0 wt. % or in the case of co-diffusion having zero to about 4 wt. % diffused aluminum wherein the orientation of the magnetic properties within a plane of the iron alloy sheet is either substantially non-oriented, textured, or grain-oriented.

In yet another aspect, the invention is a chemical vapor deposition method for making iron sheets having silicon diffused therein comprising (a) producing a continuous cast or slab product less than about 2.5 wt. % silicon; (b) forming hot bands; (c) cold rolling the bands; (d) heating the product obtained in step (c) in a gaseous atmosphere that contains a volatile silicon compound selected from the group consisting of silicon halide, silane, and substituted silane, silicon tetraacetate or silicon tetrathiocyanate; and (e) recovering an iron alloy product in the form of a sheet containing about 0.25 wt. % to about 7.0 wt. % silicon.

DETAILED DESCRIPTION

Figure 1:
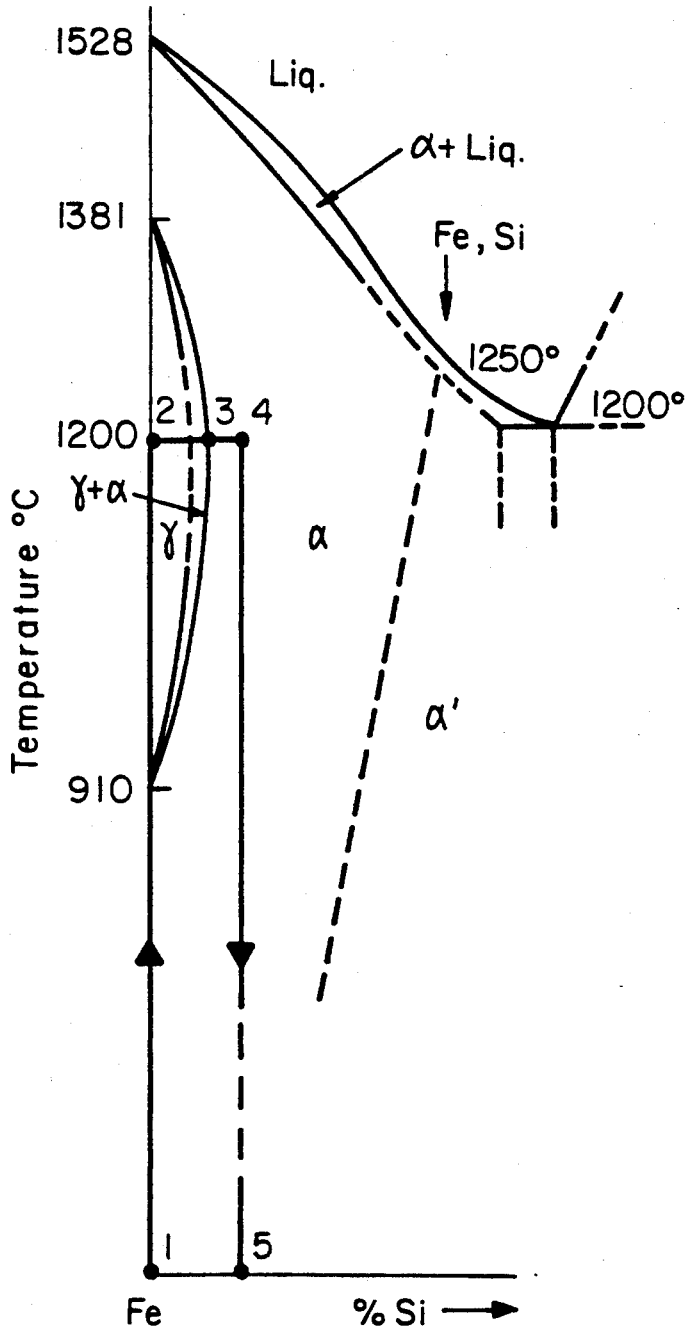
FIG. 1 shows the section of the Fe-Si phase diagram that graphically represents an embodiment of the invention.

In the present invention iron feedstock may either be diffused with silicon or silicon and aluminum by a pack diffusion or chemical vapor deposition method.

Pack diffusion is described in U.S. Pat. No. 4,904,500, incorporated herein by reference. The more important aspects of the process involve heating an iron substrate in a retort containing: (1) one or more diffusant sources such as a silicon oxide source or a combination of silicon oxide and aluminum sources; (2) an activator; (3) a reducing agent; (4) an essentially inert filler; and (5) a non-oxidizing atmosphere to form a mixture of ingredients. The ingredients are mixed and heated preferably to between approximately 900° C. to 1200° C. for 1 to 24 hours. An inert ingredient may also be added to inert the pack atmosphere.

Chemical vapor deposition is described in U.S. Pat. Nos. 3,423,253 and 3,224,909, incorporated herein by reference. The process involves heat treating the iron alloy initially containing a silicon content of greater than 3 wt % after cold rolling, in a gaseous atmosphere containing a volatile silicon compound selected from compounds, such as, silicon halide, silane, substituted silane, silicon tetraacetate or silicon tetrathiocyanate. However, in accordance with the present invention the iron feedstock may have a silicon content below about 2.5 wt. % and as low as zero wt. %.

I order to appreciate how the objectives of the invention are accomplished, it is important to understand the iron feedstock metallurgy and how the diffusion of silicon or silicon and aluminum induces changes therein. Therefore, a brief description of the metallurgy is provided below, along with details of pack diffusion.

Iron Metallurgy

Iron is the major constituent in an iron alloy for use in electrical steel applications. Iron, having a silicon content of less than about 3 wt. % or a combined silicon and aluminum content of less than about 3 wt. %, will undergo an allotropic phase transformation, as illustrated in FIG. 1 (the phase diagram for iron silicon), upon heating wherein the ferrite (alpha) phase, which is stable at temperatures below 910° C., transforms to austenite (gamma) phase. The gamma phase is more stable than the alpha phase between temperatures of 910° C. to 1381° C. Therefore the preferred temperature range for the process is from 910° C. to 1381° C., more preferably from 1150° C. to 1200° C.

As the diffusant, e.g. silicon or silicon and aluminum, diffuses into the iron feedstock, the stability of the gamma phase changes locally, due to several important reasons. One reason is that the solubility of the diffusant in the gamma phase is extremely limited, while the solubility of the diffusant in the ferrite phase is very high. However, the presence of additional constituents may affect the solubility of the diffusant into the iron feedstock. To illustrate this using a separate example, let us consider aluminizing an iron substrate. Formation of a surface layer of aluminized iron is contingent upon the formation of ferrite locally at the surface. Aluminum very readily causes the gamma to alpha transformation at very low surface concentrations. However, where Ni, Mn and C are present in the iron substrate, they may oppose the transformation of the ferrite phase due to their strong austenizing tendency. Therefore, certain constituents may actually slow down the transformation induced by the aluminum diffusant source in the iron feedstock. In addition, these constituents may affect the ability of more than one diffusant to codiffuse into the iron feedstock.

Conventional diffusion processes will form a continuous exterior barrier layer or coating of intermetallic compounds at the surface of the iron substrate. These layers act as a barrier and block the access of the diffusant to the ferrite of the diffusion layer because of the diffusants low solubility and exceedingly slow diffusion rates through the intermetallics. Pack diffusion processes avoid the formation of these continuous exterior layers and, therefore, facilitate the codiffusion of silicon and aluminum without the formation of an exterior layer. However, for pack diffusion to be successful, the activity of the diffusant or codiffusants that attempt to form an exterior layer at the surface of the feedstock must be equal to or below the activity level which leads to the formation of a continuous exterior layer. For this reason the activity of the diffusant species must be controlled. One way of accomplishing this is to use a pack diffusion process.

Pack Diffusion

Pack diffusion involves the surface treatment of metals in a pack bed, or retort, where the aggregate of the pack ingredients serve to support and generate, in-situ, the chemical reactants necessary for the surface treatment. When the form of the metal is a thin sheet, the diffusion can proceed through the entire sheet thickness.

The reactions occurring in the pack are complex and not yet fully understood, as such, detailed mechanistic studies are not available. The ingredients of the pack diffusion process according to the present invention are described below:

(i) A silicon source consisting of an oxide capable of reacting with the ingredients in the pack and forming, in-situ, the silicon diffusant that transports the silicon into the iron. Suitable silicon sources include oxides such as SiO, $SiO_2$, magnesium silicate, iron magnesium silicate and mixtures thereof.

(ii) An aluminum source typically in the form of an aluminum metal powder.

(iii) An assembly of powders, such as $Al_2O_3$ and AlN, to prevent sticking in the retort since AlN is used in the form of an extremely fine powder and tends to coat $Al_2O_3$ particles. The minimum amount of AlN to be used with $Al_2O_3$ is about 10 wt. %. AlN is also beneficial in other ways since it reacts with moisture in the pack at ambient temperature to form $Al_2O_3$ and $NH_3$. The ammonia, in turn, serves as a reducing gas within the pack process. At temperatures above about 600° F., AlN reacts with oxygen to form $Al_2O_3$ and nitrogen. Nitrogen is useful to inert the atmosphere of the retort above the ingredients. Eliminating pack contaminants of an oxidizing nature, proves to be extremely important for good operation of a high temperature pack. Therefore, AlN in some fraction above approximately 10 wt. % is a potentially desirable ingredient for good pack performance.

(iv) An essentially inert pack filler (herein after referred to as the pack filler) to serve several important functions which include: (1) providing mechanical support for the element to be diffused; (2) a pore former, to provide many gas paths for transporting the diffusant to the iron substrate's surface; (3) preventing sintering of the diffusant source particles to each other, so that the diffused iron substrate can be retrieved easily without cleaning steps to remove bound particles; and (4) to stand off alloy particles from the iron substrate surface so that they are less prone to sinter to the surface of the iron substrate; and (5) displaces unwanted air in the chamber. The pack filler preferably should constitute about 50 vol. % of the retort. It is important that the pack filler not be attacked to any extent that materially impairs its ability to function as required.

(v) An activator consisting of a volatile and reactive compound that reacts with pack ingredients to form a diffusant species which transports by diffusion to the surface of the iron feedstock to deposit the source element to be diffused. The activator may regenerate itself for further transport. The selection of a suitable activator should be made on the basis of thermodynamics, by calculating the free energy change for an anticipated reaction. If the value is negative, then the reaction can occur. The activator must be stable at high temperatures and have a vapor pressure lower than one atmosphere at the temperature of pack operation. Preferred activators are selected from ammonium salts, such as ammonium chloride, magnesium chloride, magnesium fluoride, aluminum fluoride and ammonium fluoride salts. However, ammonium fluoride is highly toxic and therefore may raise some environmental concerns. Therefore, since aluminum fluoride is less toxic than ammonium fluoride it is more preferred. The type of halide used influences the relative amounts of codiffusants employed when codiffusion is carried out. Aluminum fluoride also serves as a condensed phase activator at the pack temperatures of up to 1200° C. Condensed phase activators produce more consistent results and have an economic and environmental advantage over the more widely used ammonium halides. Other, condensed phase activators found to be acceptable include magnesium fluoride. The activator is included at a concentration of about 1 wt. % to about 3 wt. % based on the weight of pack ingredients.

(vi) An iron feedstock to be diffused with silicon or silicon and aluminum may have from zero to about 2.5 wt. % silicon and zero to about 2.5 wt. % aluminum, not to exceed a total of about 2.5 wt. % for the silicon-aluminum combination.

A characteristic feature of an iron alloy diffused with silicon or silicon and aluminum is the low concentration of interstitial elements; e.g. C, O and N. This is caused by the propagation of the gamma/alpha interface during diffusion. The interstitial solubilities in the iron feedstock are much lower in the alpha phase than in the gamma phase. Therefore, the impurities can be rejected towards the center of the iron-containing sheet as the gamma-to-alpha phase transformation front advances across multiple sides of the iron-containing sheet and escape via grain boundary diffusion to the vapor phase (provided the necessary chemistry is present for removal). On the other hand, the impurities could be rejected on a single side of the iron-containing sheet by advancing the alpha to gamma phase transformation front across the sheet by diffusion at a single surface.

In accordance with the invention, the iron feedstock may be diffused with silicon in combination with aluminum. Diffusing either aluminum, silicon or both produces a stable ferrite structure in the iron alloy product at the diffusing temperature. The codiffusion of aluminum and silicon may depend on their respective ratios within the pack. If the silicon to aluminum ratio is 3 or greater, only silicon will be diffused into the iron feedstock. However, if stoichiometric equivalents are used, aluminum tends to codiffuse to produce a silicon to aluminum diffused product where the ratio of silicon to aluminum is 5 to 1. Variations of aluminum and silicon content can be made depending on the ratio desired.

FIG. 1 shows a section of a silicon and iron binary phase diagram.

The numeric labels 1-5 as shown in FIG. 1 indicate the pathway Stages for temperature and composition which occur when the iron feedstock is heated in a pack diffusion process. As the temperature is increased from below 910° C., the low carbon steel, which at room temperature has a ferrite (alpha) structure, is transformed spontaneously to an austenite (gamma) structure. However, if the initial concentration of silicon in the iron feedstock is above the transformation limit shown in the phase diagram, then no structural changes will occur since in that case the ferrite (alpha) phase is stable at temperatures exceeding 910° C. As silica reduces to latent silicon and is transported to the surface, the high temperature causes inward diffusion. As the silicon content in the surface is raised to the phase boundary concentration proscribed by the phase diagram, the austenite (gamma) structure is isothermally transformed back to the ferrite (alpha) structure. As a result of the process, a unique metallurgical structure is formed having columnar grain boundaries.

As described below, the preferred temperature range is from 910° C. to 1381° C., more preferably from about 1150° C. to about 1200° C.

In Stage 1, the iron feedstock is at room temperature and has a stable ferrite (alpha) phase. During heating, the ferrite phase transforms to the austenite (gamma) phase at a temperature 910° C.

In Stage 2, the temperature is raised to about 1200° C. which increases the reaction of the volatile $AlF_3$ activator with the diffusant source $SiO_2$ by the action of the (reducing agent) Al generates a volatile Si—F species. The species decompose at the iron surface of the iron feedstock to release silicon at controlled activity and to recycle the fluoride species as a pack ingredient. In this manner, diffusion of silicon into the iron feedstock proceeds at a controlled silicon activity on the iron surface. To achieve the desired microstructure, the temperature and activity of the silicon species must be adjusted to promote rapid diffusion of silicon. This prevents outward diffusion of the iron and contributes to the economy of the process. The activity of the silicon species must, however, be sufficiently low to prevent the formation of iron silicide and molten eutectic phases which can form at temperatures of as low as 1200° C. to about 1250° C.

In Stage 3, the siliconizing continues at about 1200° C. until the silicon content in the iron alloy product exceeds critical concentration of about 2.5 wt. %. At this silicon concentration level, there is an isothermal phase transformation from the austenite phase to the ferrite phase. An advantage of the process is that the diffusion rates in the ferrite phase are as much as 100 times greater than in the austenite phase which provides for an economical diffusion process for siliconizing iron feedstock.

In Stage 4, the siliconizing is complete when the transformation fronts, moving inward from opposite sides, meet along the center line of the iron feedstock being siliconized.

In Stage 5 the siliconized iron alloy product is cooled to room temperature.

For processing large numbers of laminations, such as are needed for production, it became evident that a mechanical application of pack material was necessary to provide a reproducible stack density, and to reduce creep distortion of the laminations during processing due to uneven support in the retort. Therefore, both wet screen and dry screen applications were evaluated. Examination of the laminations after processing showed that the screened laminations were by far the least distorted. The wet-screening process was shown to be the preferred method, because of better adherence of pack material to the laminations. The wet screening method also gave a greater stacking density by allowing the placement of only the near-stoichiometric amount of reagent needed to provide the required silicon. The greater stacking density of laminations should further reduce the mechanical distortion due to creep for future lamination processing, because of the greater interlamination support in the dense stack.

The present invention has utility in integrated manufacturing processes for fabricating motor laminations that are substantially ready for final processing, such as cleating/welding and winding. The proposed manufacturing process incorporates: (1) controlling the pack application to achieve uniform siliconizing, with minimum usage of pack reagents, and the simultaneous generation of an insulating coating, (2) stacking the motor laminations on a mandrel/base support to meet dimensional tolerances, and (3) thermally integrating pack processing treatments, such as decarburization, to minimize costs. As a posttreatment step, laser cutting may be used to achieve final mechanical tolerance.

The integrated process permits the processing of conventional cold rolled motor lamination steel (referred to hereinafter as "CRML") as well as commercially available low alloy content and low carbon content steels. Adoption of the present manufacturing technique may lessen disruption to existing manufacturing operations. An advantage of the present method is that chemical reagents need only to be applied to every other lamination, to provide electrical insulation. Another application for the process is the use of CRML, which has seen prior thermal and mechanical processing, to enhance texturing of the final iron alloy product. The process of the present invention allows the surface modification of bulk materials or the modification of sheet materials.

In order to more fully illustrate the nature of the invention and the manner of practicing same the following examples are presented. These examples are not to be construed as limiting the scope of the invention, as various changes to the details of the invention will be apparent to those skilled in the art.

EXAMPLES

The Manufacture of Epstein Strips and Rings

Pack Diffusion

A cold rolled motor lamination iron material containing nominally zero wt. % silicon was used as a starting material. The material was formed into 3 cm×30 cm strips also known as Epstein strips. Alternatively, the material was formed into rings having 6⅛ inch I.D. and 7½ inch O.D. also known as Epstein rings. Whether in the form of a strip or a ring the gauge thickness of the material is 24 to 26 gauge. The material was placed in a sealed glass retort, capable of simultaneously processing six to eight Epstein strips. In those cases where the material contained excessive amounts of carbon, carbide precipitation was avoided by carrying out a preliminary decarburization step. The other materials placed in a retort include: (a) silica sand (silicon source) (up to 78 wt. %); (b) AlN or MgO filler material (up to about 90 wt. %); (c) an $AlF_3$ activator (up to 3 wt. %); and (d) Fe(10 wt. %-Al alloy (up to 30 wt. %). For continual reuse of the diffusion pack, the composition of the Al and Si sources in the pack were continually replenished as they were depleted. The entire contents of the pack was heated to 1170° C. for six hours. The resulting product contained a columnar grain boundary structure extending inwards from opposite sides of the sheet towards the center, or from a single side of the sheet. In some cases the iron alloy product was subjected to a post pack treatment at 1200° C. in vacuum for up to 24 hours.

The results in Table I show that the electromagnetic properties of the iron were significantly improved when compared to that of the starting materials. Based on the results of experiments run at various temperatures throughout the austenite (gamma) phase range, we were able to conclude that the diffusion may be performed at temperatures as low as 1125° C., but temperatures approaching or at 1200° C. were preferred to eliminate the diffusion of iron out of the product and to promote optimum silicon diffusion and minimize aluminum diffusion. Increasing the aluminum content of the Fe-Al alloy from 10% to 30% aluminum resulted in increased silicon content of the product to about 6 to 7% silicon. Although both argon and hydrogen constitute suitable atmospheres in the retort during siliconizing, hydrogen consistently produced double the amount of silicon in the steel for a given iron-aluminum reagent composition. Also, the amount of aluminum could be adjusted by controlling the silica to aluminum ratio in the pack. An amount of silica in excess of three times the stoichiometric requirement of silica for a given amount of aluminum, was shown to reduce the residual aluminum content in the iron to less than 0.1%. Decreasing the ratio was shown to control the amount of aluminum up to concentrations about equal with the iron. The pack diffusion could be run at temperatures in excess of 1200° C. in order to decrease the diffusion time.

Chemical Vapor Deposition

A CRML iron feedstock containing nominally zero weight % silicon was used as a starting material. The material in the form of 3 cm×3 cm coupons, was placed on a SiC—coated susceptor in a quartz tube, and inductively heated in a flowing $H_2$—1%$SiH_4$ stream for about 1 hr at 1125° C. The material, upon removal, was found to have a columnar grain boundary structure as illustrated in FIG. 1. Analysis showed the composition to be about 3.5 weight % silicon.

Fabrication and Evaluation of a 5HP Motor

In addition, the process and product of the present invention can be used to fabricate a 5 HP pre-prototype test motor from siliconized CRML steel laminations as outlined below.

Standard 26 gauge (0.018") CRML steel was first stamped into 7¾-inch motor laminations. After decarburization by a standard process for about one hour at 843° C. in partially combusted methane adjusted to a specified $H_2O$ content, the laminations were siliconized by the process of the present invention. The siliconized laminations were coated with a C-6 organic/inorganic varnish to ensure adequate interlaminar resistance for the completed stator stack.

The coated laminations were assembled on an expanding arbor to a stack height of 4.5 inches and TIG welded. A core-check performed on the stator gave 238 watts, as compared to 210 watts nominal for commercial 3% Silicon steel. Windings were machine wound and hand inserted to insure the same copper fill as used in the comparison commercial 5 HP motor. After light machining of the stator ID, the test motor was assembled and found to function properly for comparative testing and evaluation versus the standard commercial 5 HP energy efficient motor. The comparison data provided in Table 2 and Table 3 indicates good performance for the Controlled Activity Diffusion (hereinafter referred to as "CAD") siliconized steel versus the commercial silicon steel

TABLE I

| Sample | Thickness | Pack Process | Post-Pack Treatment | Composition Wt. % Si | Composition Wt. % Al | Magnetic Properties @ 15 KG, 60 Hz Core Loss (W/lb) | Magnetic Properties @ 15 KG, 60 Hz P-Perm (G/Oe) |
|---|---|---|---|---|---|---|---|
| (Epstein Strips) | | | | | | | |
| Commercially available Silicon Steel | 50-50(1)/24 ga, 24 mil | — | — | 3 | — | 2.03 | 1,118 |
| Commercially available Silicon Steel | 50-50(1)/26 ga, 18 mil | — | — | 3 | — | 1.80 | 915 |
| Commercially available Decarburized CRML | 50-50/26 ga, 18 mil | — | — | 0 | — | 3.68 | 3,280 |
| Decarburized | | | | | | | |
| 1 | LONG/24 ga, 26 mil | AlN | 1200° C./VAC | 5.8 | — | 1.90 | 205 |
| 2 | LONG/26 ga, 20 mil | AlN | 1200° C./VAC | 5.1 | — | 1.55 | 233 |
| 3 | TRANS/26 ga, 20 mil | AlN | None | 2.8 | — | 2.03 | 667 |

TABLE I-continued

| Sample | Thickness | Pack Process | Post-Pack Treatment | Composition Wt. % Si | Composition Wt. % Al | Magnetic Properties @ 15 KG, 60 Hz Core Loss (W/lb) | Magnetic Properties @ 15 KG, 60 Hz P-Perm (G/Oe) |
|---|---|---|---|---|---|---|---|
| 4 | TRANS/26 ga, 20 mil | AlN | 1200° C./VAC | 2.8 | — | 1.86 | 781 |
| 5 | LONG/26 ga, 20 mil | AlN | 1200° C./VAC | 2.8 | — | 1.96 | 985 |
| 6 | LONG/26 ga, 20 mil | MgO | None | 3.5 | 0.6 | 2.28 | 190 |
| 7 | LONG/26 ga, 20 mil | MgO | 1200° C./VAC | 3.5 | 0.6 | 2.09 | 445 |
| 8 | TRANS/26 ga, 20 mil | MgO | 1200° C./VAC | 3.5 | 0.6 | 2.43 | 356 |
| 9 | LONG/26 ga, 20 mil | MgO | 1200° C./VAC | 3.4 | 2.2 | 1.89 | 423 |
| (Epstein Rings) | | | | | | | |
| Decarburized Commercially available CRML | 26 ga, 18 mil | — | — | 0 | — | 3.72 | 1,800 |
| Commercially available Silicon Steel (Motor Steel) | 26 ga, 18 mil | — | — | 3 | — | 1.78 | 750 |
| 1 | 26 ga, 20 mil | AlN | 1200° C./VAC | 3.1 | — | 2.14 | 570 |
| 2 | 26 ga, 20 mil | AlN | 1200° C./VAC | 3.1 | — | 1.98 | 580 |
| 3 | 26 ga, 20 mil | MgO | None | ~2% Si | 0.3% Al | 2.65 | 600 |

(1)50/50 = a mix of strips cut longitudinal and transverse to the strip rolling direction.

TABLE II

PERFORMANCE COMPARISON OF 5 HP MOTORS (STANDARD ENERGY EFFICIENT VS. CAD SILICONIZED STEEL)

| Item | Standard Energy Efficient Steel | CAD Siliconized | NEMA Standard |
|---|---|---|---|
| Power Source | SINE WAVE 60 Hz | SINE WAVE 60 Hz | SINE WAVE 60 Hz |
| Service Factor | 1.00 | 1.00 | 1.00 |
| HP | 5.04 | 5.05 | — |
| Volts | 460 | 460 | — |
| Amperes | 6.05 | 6.39 | — |
| RPM | 1748 | 1749 | — |
| Full Load Torque (LB-FT) | 15.02 | 15.01 | — |
| Locked Roter Amps | 42.9 | 44.7 | 46 |
| Locked Rotor Torque (% FLT) | 200 | 209 | 185 |
| Pull Up Torque (% FLT) | 186 | 209 | 130 |
| Break Down Torque (% FLT) | 293 | 309 | 225 |
| Temperature Rise (Degrees C.) | * | * | 80 |
| Efficiency (%) | 89.9 | 89.0 | 85.5 |
| Power Factor (%) | 86.8 | 83.1 | |
| No Load Amps | 1.725 | 2.525 | |
| No Load Watts | 101 | 149 | |
| Resistance (Line-to-Line) | 2.834 | 2.904 | |

*Data at 60° C.

TABLE III

RELIANCE DATA ON WATTS LOSS IN MOTORS (TYPE EBL-184T; 5HP-4P)

| WATTS LOSS AREA | STANDARD ENERGY EFFICIENT MOTOR* | TEST MOTOR** |
|---|---|---|
| 1. Iron (Primarily Stator) | 55 | 83 |
| 2. Stator $I^2R$ | 177 | 202 |
| 3. Rotor $I^2R$ | 114 | 112 |
| 4. Friction and Windage | 29 | 27 |
| 5. Stray Load Loss | 47 | 40 |
| TOTAL LOSS: | 422 | 464 |

*@ 5.05 HP output
**@ 5.04 HP output

What is claimed is:

1. A pack diffusion method for making iron alloy products in the form of thin gauge sheets having diffused silicon or silicon and aluminum comprising:

adding to a retort (a) an iron feedstock; (b) a silicon oxide source, aluminum source or a combination thereof; (c) a reducing agent; (d) an activator; and (e) an essentially inert filler wherein said filler contains aluminum nitride to form a mixture of ingredients;

providing a non-oxidizing atmosphere within the retort;

heating the mixture for a time sufficient to reduce said silicon oxide source and create a silicon diffusant to diffuse silicon into the iron feedstock and to create an aluminum diffusant for diffusing aluminum into the iron feedstock;

recovering an iron alloy product containing about 0.25 wt. % to about 7.0 wt. % silicon, and 0 wt. % to about 4 wt. % aluminum, wherein the orientation of the magnetic properties within a plane of the iron alloy product is substantially non-oriented, textured, or grain oriented.

2. The method in claim 1 wherein the orientation of magnetic properties within a plane of a sheet of the iron alloy product has a columnar grain boundary structure that is substantially grain oriented.

3. The method in claim 1 wherein the iron feedstock contains less than about 2.5 wt. % combined of silicon and aluminum.

4. The method in claim 1 wherein the iron feedstock is a low carbon content steel.

5. The method in claim 1 wherein the silicon oxide source is selected from the group consisting of silicon dioxide, silicon monoxide, magnesium silicate, and iron magnesium silicate.

6. The method of claim 1 wherein the aluminum source is aluminum powder.

7. The method in claim 1 wherein the reducing agent is selected from the group consisting of iron-aluminum alloy and aluminum powder.

8. The method in claim 1 wherein the activator is selected from the group consisting of aluminum trifluoride, sodium aluminum fluoride (cryolite), magnesium fluoride, ammonium fluoride and ammonium iodide.

9. The method in claim 1 wherein the inert filler further comprises magnesium oxide.

10. The method in claim 9 wherein the inert filler is from about 10 wt. % to about 30 wt % aluminum nitride and from about 10 wt. % to about 50 wt % of magnesium oxide.

11. A method for manufacturing iron based electrical products having diffused silicon or silicon and aluminum substantially in final form by a process comprising:

(a) adding to a retort an iron feedstock; silicon oxide source or a combination of silicon oxide source and aluminum source; a reducing agent; an activator; and an essentially inert filler which contains aluminum nitride to form a mixture of ingredients; (b) providing a non-oxidizing atmosphere within the retort; (c) heating the mixture for a time sufficient to reduce said oxide and create a silicon diffusant or silicon and aluminum diffusant to diffuse silicon or silicon and aluminum into the iron feedstock; and (d) recovering an electrical product substantially in final processing form, wherein the product contains from about 0.25 wt. % to about 7.0 wt. % silicon, about 0 wt. % to about 4 wt. % aluminum, and wherein the orientation of the magnetic properties within a plane of the sheet of the iron alloy product is substantially non-oriented, textured or grain-oriented.

12. The method in claim 11 wherein the iron based electrical products are motor laminations.

13. The method in claim 12 wherein the motor laminations are clamped together to form a stator stack.

14. The method of claim 13 wherein the motor laminations have a coating of the silicon oxide source, reducing agent, activator and inert filler.

15. The method in claim 11 further comprising mounting the motor laminations on an mandrel thereby preserving a particular geometric shape.

16. A method for manufacturing iron based electrical products having diffused silicon or silicon and aluminum substantially in final form by a process comprising:

(a) adding to a retort an iron feedstock; silicon oxide source or a combination of silicon oxide source and aluminum source; a reducing agent; an activator; and an essentially inert filler to form a mixture of ingredients; wherein the silicon oxide source and filler is silicon dioxide, and wherein the reducing agent is aluminum powder and wherein the activator is aluminum fluoride;

(b) providing a non-oxidizing atmosphere within the retort;

(c) heating the mixture for a time sufficient to reduce silicon dioxide and create a silicon diffusant or silicon and aluminum diffusant to diffuse silicon or silicon and aluminum into the iron feedstock; and (d) recovering an electrical product substantially in final processing form, wherein the product contains from about 0.25 wt. % to about 7.0 wt. % silicon, about 0 wt. % to about 4 wt. % aluminum, and wherein the orientation of the magnetic properties within a plane of the sheet of the iron alloy product is substantially non-oriented, textured or grain-oriented.

17. The method of claim 16 wherein the iron based electrical products are motor laminations.

18. The method of claim 17 wherein the motor laminations are clamped together to form a stator stack.

19. The method of claim 18 wherein the motor laminations have a coating of the silicon oxide source, reducing agent, activator and inert filler.

20. The method in claim 16 further comprising mounting the motor laminations on a mandrel thereby preserving a particular geometric shape.

21. A method for manufacturing iron based electrical products having diffused silicon or silicon and aluminum substantially in final form by a process comprising:

(a) adding to a retort an iron feedstock; a silicon oxide source or a combination of silicon oxide source and aluminum source; a reducing agent; an activator; and an essentially inert filler to form a mixture of ingredients; wherein the silicon oxide source, and reducing agent and filler is silicon monoxide, and wherein the activator is aluminum fluoride;

(b) providing a non-oxidizing atmosphere within the retort;

(c) heating the mixture for a time sufficient to reduce silicon monoxide and create a silicon diffusant or silicon and aluminum diffusant to diffuse silicon or silicon and aluminum into the iron feedstock; and (d) recovering an electrical product substantially in final processing form, wherein the product contains from about 0.25 wt % to about 7.0 wt. % silicon, about 0 wt. % to about 4 wt. % aluminum, and wherein the orientation of the magnetic properties within a plane of the sheet of the iron alloy product is substantially non-oriented, textured or grain-oriented.

22. The method in claim 21 wherein the iron based electrical products are motor laminations.

23. The method in claim 22 wherein the motor laminations are clamped together to form a stator stack.

24. The method of claim 23 wherein the motor laminations have a coating of the silicon oxide source, reducing agent, activator and inert filler.

25. The method in claim 21 further comprising mounting the motor laminations on a mandrel thereby preserving a particular geometric shape.

* * * * *